United States Patent [19]

Mäkinen et al.

[11] 4,411,631

[45] Oct. 25, 1983

[54] PROPELLER GUARD

[75] Inventors: Eero Mäkinen, Espoo; Stefan Gordin, Helsinki, both of Finland

[73] Assignee: Oy Wartsila Ab, Helsinki, Finland

[21] Appl. No.: 300,201

[22] Filed: Sep. 8, 1981

Related U.S. Application Data

[63] Continuation of Ser. No. 79,715, Sep. 28, 1979, abandoned.

[30] Foreign Application Priority Data

Sep. 29, 1978 [FI] Finland ..... 782966

[51] Int. Cl.[3] ..... B63H 5/16

[52] U.S. Cl. ..... 440/72

[58] Field of Search ..... 440/71–73; 114/56, 57

[56] References Cited

U.S. PATENT DOCUMENTS

| | | | |
|---|---|---|---|
| 1,024,119 | 4/1912 | Cox | 114/57 |
| 1,055,874 | 3/1913 | Campbell | 114/57 |
| 1,072,270 | 9/1913 | Tagliamonte | 440/72 |
| 1,620,129 | 3/1927 | Peterson | 440/72 |
| 4,078,516 | 3/1978 | Balius | 440/72 |

*Primary Examiner*—Trygve M. Blix
*Assistant Examiner*—Jesús D. Sotelo
*Attorney, Agent, or Firm*—McAulay, Fields, Fisher, Goldstein & Nissen

[57] ABSTRACT

A vessel, in particular a ferry, intended for use in ice-filled waters, is provided with a propeller guard having the form of a rigid grid construction and being arranged to enclose one or several propellers acting in the front part of said vessel and/or below the keel line of said vessel. The width of the guard at its upper edge at the hull of the vessel is at least substantially equal to the greatest width of the guard. At its front end, the guard has an oblique front edge which, in a longitudinal section, is at least to its major part, inclined relative to a horizontal plane at the most 50°, preferably at the most 45°.

14 Claims, 3 Drawing Figures

PROPELLER GUARD

Figure 1:
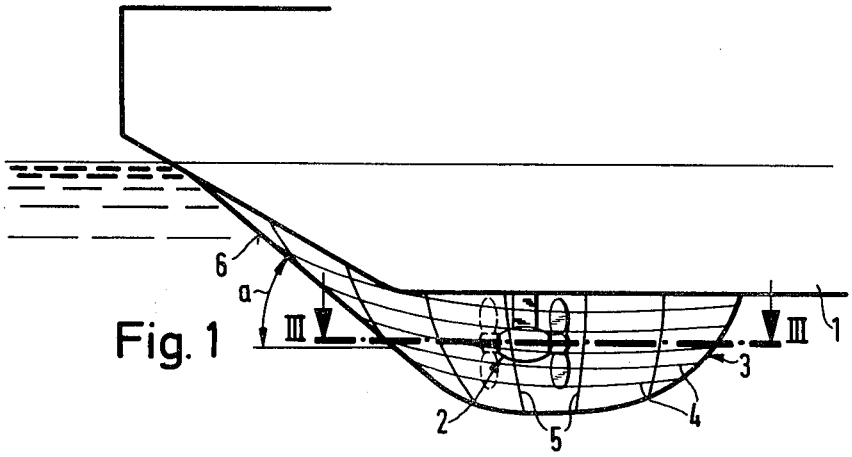

This is a continuation of application Ser. No. 79,715, filed Sept. 28, 1979, now abandoned.

The invention relates to a propeller guard made in the form of a rigid grid construction and fitted to enclose one or, jointly, several propellers of a vessel, in particular a ferry, intended for use in ice-filled waters.

It is known per se to protect the propeller of a vessel moving in ice-filled waters with a propeller guard. However, known propeller guards tend to collect ice blocks in front of themselves, whereby they may considerably reduce the thrust of the propeller and thereby slow down the movement of the vessel. In addition, the resistance of a propeller guard is, due to its blunt form, great in waters containing ice blocks. An object of the invention is to provide a propeller guard which guides the ice blocks present in the water to the sides of and below the guard, so that there will not be any ice block cloggings in front of the guard causing reduced propeller thrust and increased movement resistance for the vessel.

The invention is characterized in that at the front end of the guard, the oblique front edge, at least to its major part, is inclined relative to a horizontal plane, at the most 50°, preferably at the most 45°, as viewed from the side. In known propeller guards the front edge has been practically vertical, which has had a considerable harmful influence on the sliding of the ice past the propeller guard and has under severe ice conditions considerably reduced the advancement ability of the vessel. By using a propeller guard according to the invention, the ice blocks slide smoothly past the sides and below the propeller, and due to this, the harm caused by ice blocks will be relatively small.

A propeller guard is used, in particular in ferries, which usually have a propeller unit at both ends rotatable around a vertical axis. The effect of the ice conditions are worse when the propeller unit is at the front end of the ferry relative to its direction of movement, and due to this, particular attention has been paid to such a case when developing the invention. Hence, the expression "the front edge of the propeller guard" or "front portion", is used in the specification and in the claims, and this means that part of the guard which is closer to the adjacent end of the vessel in question.

In a preferred embodiment of the invention, those parts of the grid construction forming the propeller guard, passing at the sides of the propeller, are as a whole at least partly clearly deviating from their horizontal plane in a direction which approximately corresponds to the sliding direction of the ice blocks. In known propeller guards, the horizontal parts of the grid construction are horizontal in their entirety, whereby, in particular in front and behind the propeller, where the ice blocks also have to move vertically, the construction has obtained a form which has had a considerably harmful influence on the sliding of the ice blocks past the propeller guard and, in particular, in a direction towards its bottom.

In known propeller guards, the bottom of the guard is usually horizontal. The front and rear edges of the propeller guard are usually connected to that bottom so that at the points of connection a distinct angle is formed or at least an area where the outline of the profile of the propeller guard in a longitudinal section changes its direction considerably. In a propeller guard according to the invention, the aim is that this kind of discontinuous portions should not occur, but that the bottom edge of the propeller guard, as viewed from the side would form a smooth curve with a smooth, continuous connection to the front and rear edges of the propeller guard. Due to this the ice blocks move in the best way past the propeller guard. Also, it is important that the rear portion of the propeller guard is streamlined with respect to the movement of the ice blocks.

It has also been established that the form of the propeller guard in a horizontal plane and its form in a vertical plane should have a certain relationship to each other. Consequently, in a preferred embodiment of the invention, the propeller guard is so formed, that in a horizontal plane through the center of the propeller the sum of the angle between the side outlines of the guard and the inclination angle of the front edge of the guard is smaller than 140°, and preferably smaller than 120°. The expression "the angle between the side outlines" means that the angle between the actual side surfaces of the propeller guard should be measured at the front edge of the guard.

In known propeller guards, the horizontal parts of the grid structure are usually made from flat irons. In a propeller guard according to the invention, this manner of construction is not suitable, but it is recommended to form the grid structure from such structural elements that at least their outer side which is exposed to ice-contact has a rounded-off form. It is possible to use structural elements which have a circular cross-section, but also other forms for the structural elements can be used, which are more favourable with respect to the streaming water and the movement of ice blocks.

Since in a propeller guard according to the invention, in particular the structural elements which extend substantially in the longitudinal direction of the vessel guide the ice blocks past the propeller and the propeller guard, and the most favorable solution is that the substantially vertically extending structural elements of the grid construction supporting said longitudinally extending structural elements are located inside the longitudinally extending structural element.

Since a propeller guard according to the invention is designed considering the movement paths of the ice blocks, the propeller guard will be considerably longer than conventional propeller guards. It has been established that a suitable ratio of the length and the width of a propeller guard according to the invention measured along the bottom of the vessel is in a one propeller guard at least 2.0, and preferably at least 2.2 and in a multi-propeller guard at least 1.3 preferably at least 1.5.

Figure 2:
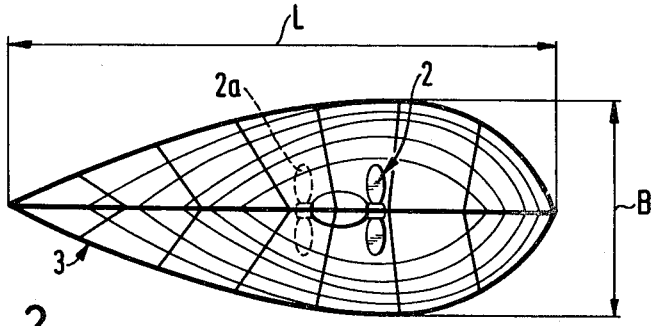
Figure 3:
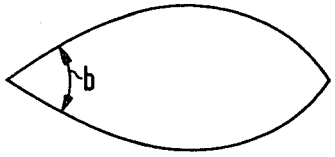

In the following, the invention will be described more in detail with reference to the attached drawing, in which FIG. 1 shows a side-view of a propeller guard according to the invention, FIG. 2 shows a view from below of a propeller guard according to the invention, FIG. 3 shows a horizontal section of a propeller guard according to the invention through the center of the propeller.

In the drawing, 1 indicates the hull of a ferry, 2 one of its propeller units and 3 a propeller guard arranged around the propeller. The propeller guard is formed by substantially horizontal members 4, passing at both sides of the propeller, and of substantially vertical members 5, the members forming together a grid construction surrounding the propeller unit 2. However, horizontal members 4 are not horizontal over their whole length, but in particular at the front end of the propeller guard they deviate in an upward direction considerably from their horizontal plane, so that guiding tracks are formed following the moving direction of the ice blocks present in the ambient water. The angle of inclination of the front edge of the propeller guard with respect to a horizontal plane should be at the most 50°, preferably at the most 45°. Front edge 6 continues below and behind propeller unit 2 so that a smooth continuous curve without sharp angles is formed.

FIG. 2 shows a propeller guard according to FIG. 1 seen from below. The Figure shows that propeller unit 2 can be turned around so that it also functions in an opposite direction in position 2*a*. If the vessel is provided with two propeller units arranged relatively close together, a single propeller guard can be built around both propeller units. Since a propeller guard according to the invention requires rather much space in its longitudinal direction, it might be necessary, in particular in a case where two propeller units, one beneath the other, are to be included into the same propeller guard, to form the front end of the propeller guard as a rather broad wedge in order to avoid that the angle between the side surfaces of the guard would be too great.

FIG. 3 shows a section of a propeller guard according to the invention in a horizontal plane through the center of the propeller. At the front end of the propeller guard the angle b between the side surfaces usually is to be made smaller the greater the angle of inclination (FIG. 1) of the front edge of the propeller guard. The most favourable relation between these two angles can be expressed so that the sum of angles a and b should be smaller than 140°, preferably smaller than 120°.

In the shown embodiment, constructional elements 4 and 5 of the grid construction of the propeller guard are steel bars with a round cross-section. This, however, is unfavourable as regards the water resistance, and hence, it is in many cases better to use as constructional elements bars with a more streamlined cross-section which, nevertheless, still have a round outer portion in order to minimize the ice resistance. Substantially vertical constructional elements 5 of the grid construction are preferably attached to the inside of substantially horizontal constructional elements 4.

FIG. 2 shows a normal propeller guard according to the invention in which the ratio of its length L and its width B measured along the bottom of the vessel is, in a one propeller guard, at least 2.0, and preferably at least 2.2. In a multi-propeller guard the corresponding ratio should be at least 1.3, and preferably at least 1.5.

The invention is not limited to the shown embodiment, but several modifications of the invention are feasible within the scope of the attached claims.

We claim:

1. An ice guard surrounding the propeller of a vessel, in particular a ferry intended for traffic in ice-filled waters, having a propeller mechanism with at least one propeller unit positioned in the front part of said vessel for propulsion, comprising:

a rigid grid unit with a general outer form free of discontinuous portions and arranged completely to enclose said at least one propeller unit, said grid unit being attached to and supported by a, at least in the transverse direction of the vessel, substantially horizontal bottom surface of the vessel, the width of said grid unit at its upper edge at said bottom surface of the vessel, being at least 80 percent of the greatest width of the grid unit and the length of said grid unit being a small part of the length of said vessel, said grid unit having, at the end thereof closer to said front part of said vessel, an oblique front portion, which at least substantially all over, in a central longitudinal section of the grid, is inclined relative to a horizontal plane at an angle of at the most 50°, and said grid unit having a plurality of substantially horizontal constructional grid-forming elements, said elements forming an angle with said oblique front portion, and having, close to said front portion an obliquely downwardly directed position corresponding to the gliding direction of ice blocks passing said ice guard when said vessel is moving through ice-filled waters.

2. A propeller guard for a vessel, in particular a ferry intended for use in ice-filled waters, having a propeller mechanism with at least one propeller unit positioned in the front part of said vessel for propulsion, comprising:

a rigid grid construction with a general outer form free of discontinuous portions and arranged completely to enclose said at least one propeller unit, said grid unit being attached to and supported by a, at least in the transverse direction of the vessel, substantially horizontal bottom surface of the vessel, the width of said grid at its upper edge at the hull of the vessel, being at least 80 percent of the greatest width of the grid and the length of said grid being a small part of the length of said vessel, and said grid having, at that end thereof which is closer to an adjacent end of the vessel, an oblique front edge, which at least substantially all over, in a central longitudinal section of the grid, is inclined relative to a horizontal plane at an angle of at the most 50°.

3. A propeller guard for a vessel having a propeller mechanism with at least one propeller unit acting in the front part of said vessel for propulsion thereof, in particular a ferry intended for use in ice-filled waters, said guard comprising:

a rigid grid construction with a general outer form free of discontinuous portions and arranged completely to enclose said at least one propeller unit;

the width of said grid at its upper edge at the hull of the vessel, being at least substantially equal to the greatest width of the grid and the length of said grid being a small part of the length of said vessel; and said grid having, at that end thereof which is closer to an adjacent end of the vessel, an oblique front edge, which over at least its major part, in a central longitudinal section of the grid, is inclined relative to a horizontal plane at an angle of at the most 50°;

said rigid grid construction including substantially vertical structural elements and continuous substantially horizontal structural elements, said substantially vertical structural elements being located inside said substantially horizontal structural elements and said horizontal structural elements pass on both sides of said propeller unit in a longitudinal direction of the vessel as viewed from a side thereof; and a longitudinal frame element extending in a substantially horizontal plane having a bottom edge which extends in the longitudinal direction as viewed from the side of the vessel to form a smooth curve with a smooth, continuous connection to the front and rear edges of the propeller guard such that said longitudinal central frame element and said structural elements which extend in the substantially longitudinal direction of the vessel guide ice blocks past the propeller and the propeller guard.

4. A propeller guard according to claim 2 or 3, in which said front edge is, in a longitudinal section of the guard, inclined relative to a horizontal plane at the most 45°.

5. A propeller guard according to claim 2, in which said grid construction includes substantially horizontal continuous structural elements each having one portion lying in a horizontal plane and another continuous portion clearly deviating from said horizontal plane in a direction which approximately corresponds to the sliding direction of ice blocks present in the ambient water such that the bottom edge of the propeller guard, as viewed from the side would form a smooth curve with a smooth, continuous connection to the front and rear edges of the propeller guard to guide the ice blocks past the propeller and the propeller guard.

6. A propeller guard according to claim 2, having a bottom outline, which, as viewed from the side, forms together with the front and rear outlines of the propeller guard a smooth, continuous curve free of sharp angles.

7. A propeller guard according to claim 2, in which, at a horizontal plane through the center of said propeller, the sum of the angle between the side outlines of the guard in said plane and the inclination angle of said front edge of the guard at said plane is smaller than 140°.

8. A propeller guard according to claim 7, in which the sum of said two angles is smaller than 120°.

9. A propeller guard according to claim 2, including substantially vertical structural elements and substantially horizontal structural elements forming said grid construction, said substantially vertical structural elements being located inside said substantially horizontal structural elements and said horizontal structural elements pass both sides of said propeller unit such that said structural elements which extend in a substantially longitudinal direction of the vessel guide ice blocks past the propeller and the propeller guard.

10. A propeller guard according to claim 2, in which at least the outer side of the structural elements of said grid construction exposed to ice contact has a rounded-off form to minimize ice resistance.

11. A propeller guard according to claim 2, in which the ratio of the length and the width of the propeller guard measured along the bottom of the vessel is, in a one propeller guard, at least 2.0, and, in a multi-propeller guard, at least 1.3.

12. A propeller guard according to claim 11, in which said ratio is, in a one propeller guard, at least 2.2, and, in a multi-propeller guard, at least 1.5.

13. A propeller guard according to claim 2, in which said propeller mechanism includes two propeller units, at least one of the propeller units acting in the front part of the vessel below the keel line.

14. A propeller guard according to claim 2, having a width at its upper edge substantially equal to the greatest width of the grid.

* * * * *